US009096353B2

(12) United States Patent
Pierre

(10) Patent No.: US 9,096,353 B2
(45) Date of Patent: Aug. 4, 2015

(54) SEALING MEMBER AND FLUID-PRODUCT DISPENSER INCLUDING SUCH A MEMBER

(75) Inventor: Christophe Pierre, Saint Sebastien de Morsent (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 13/880,454

(22) PCT Filed: Oct. 18, 2011

(86) PCT No.: PCT/FR2011/052434

§ 371 (c)(1),
(2), (4) Date: Apr. 19, 2013

(87) PCT Pub. No.: WO2012/052678

PCT Pub. Date: Apr. 26, 2012

(65) Prior Publication Data

US 2013/0200112 A1 Aug. 8, 2013

(30) Foreign Application Priority Data

Oct. 21, 2010 (FR) ..... 10 58599

(51) Int. Cl.

| | |
|---|---|
| ***B65D 47/00*** | (2006.01) |
| ***B65D 35/44*** | (2006.01) |
| ***B65D 47/08*** | (2006.01) |
| ***B65D 75/58*** | (2006.01) |

(52) U.S. Cl.

CPC ..... *B65D 35/44* (2013.01); *B65D 47/0847* (2013.01); *B65D 75/5877* (2013.01)

(58) Field of Classification Search

CPC ..... B65D 35/44; B65D 43/161; B65D 43/00; B65D 37/00; B65D 47/0874; B65D 75/5877

USPC ..... 222/546, 556, 557, 92, 106; 383/80, 96; 220/254.3, 258.3, 259.1

See application file for complete search history.

(56) References Cited

U.S. PATENT DOCUMENTS

| | | | | |
|---|---|---|---|---|
| 3,016,168 | A | 1/1962 | Larson | |
| 4,106,672 | A * | 8/1978 | Tecco et al. | 222/151 |
| 4,262,802 | A * | 4/1981 | Laauwe | 206/540 |
| 4,496,069 | A * | 1/1985 | Winkless et al. | 220/260 |

(Continued)

FOREIGN PATENT DOCUMENTS

| | | |
|---|---|---|
| EP | 1 870 346 A1 | 12/2007 |
| WO | 97/00206 A1 | 1/1997 |

(Continued)

OTHER PUBLICATIONS

International Preliminary Report on Patentability for PCT/FR2011/052434.

*Primary Examiner* — Lien Ngo

(74) *Attorney, Agent, or Firm* — Sughrue Mion, PLLC

(57) ABSTRACT

A stopper member for mounting on an opening of a fluid reservoir. The member includes a base body forming a fluid dispenser orifice; an assembly part in which the base body is received in stationary manner; and a closure lid for closing the dispenser orifice. The lid is connected to the assembly part via a hinge, the lid and the part being made as a single piece, the lid initially being connected to the assembly part via at least one bridge of breakable material, before the lid is opened for the first time. The base body is contained entirely inside the assembly part.

14 Claims, 2 Drawing Sheets

(56) References Cited

U.S. PATENT DOCUMENTS

| | | | | |
|---|---|---|---|---|
| 5,897,033 | A * | 4/1999 | Okawa et al. | 222/212 |
| 5,975,368 | A * | 11/1999 | Wood | 222/151 |
| 7,712,638 | B2 * | 5/2010 | Kick | 222/480 |
| 8,074,840 | B2 * | 12/2011 | Pennaneac'h | 222/103 |
| 8,336,725 | B2 * | 12/2012 | Ramsey et al. | 220/254.3 |
| 2005/0207680 | A1 * | 9/2005 | Schumacher et al. | 383/66 |
| 2007/0263947 | A1 | 11/2007 | Duquet et al. | |
| 2008/0173671 | A1 * | 7/2008 | Pennaneac'h | 222/107 |
| 2010/0133273 | A1 * | 6/2010 | Thurman et al. | 220/260 |
| 2011/0170807 | A1 * | 7/2011 | Khubani | 383/81 |

FOREIGN PATENT DOCUMENTS

| | | | |
|---|---|---|---|
| WO | 2007/125241 | A1 | 11/2007 |
| WO | 2010/047814 | A2 | 4/2010 |

* cited by examiner

SEALING MEMBER AND FLUID-PRODUCT DISPENSER INCLUDING SUCH A MEMBER

CROSS REFERENCE TO RELATED APPLICATIONS

This application is a National Stage of International Application No. PCT/FR2011/052434 filed Oct. 18, 2011, claiming priority based on French Patent Application No. 10 58599 filed Oct. 21, 2010, the contents of all of which are incorporated herein by reference in their entirety.

The present invention relates to a stopper member for mounting on an opening of a fluid reservoir, in such a manner as to constitute a fluid dispenser. In addition, the present application also relates to a fluid dispenser including such a stopper member. Various stopper members are used on all types of dispenser in numerous fields, and in particular in the fields of perfumery, cosmetics, and pharmacy. The first function of a stopper member is to enable fluid stored in the reservoir on which the stopper member is mounted to be dispensed selectively.

In the prior art, document WO 2007/125241 is already known, which describes a stopper member comprising: a base body forming a fluid dispenser orifice; an assembly part in which the base body is received in stationary manner; and a closure lid for closing the dispenser orifice, the lid being connected to the assembly part via a hinge, the lid and the part being made as a single piece, the lid initially being connected to the assembly part via at least one bridge of breakable material, before the lid is opened for the first time.

The stopper member of that document forms a stopper member of the kind that can be qualified as "inert", in that it incorporates neither a pump nor a valve. In other words, the fluid is not put under pressure in an inner chamber formed by the stopper member. The stopper member is rather similar to a conventional closure device including a dispenser orifice that can be closed by means of a stopper. That particular type of stopper member is for associating with a reservoir in the forms of a flexible pouch that the user can squeeze.

Dispensers incorporating that type of stopper member are often used as samples, and as a result may be inserted in specialized magazines as a promotion. However, regulations exist concerning the strength of dispensers, since they are subjected to significant pressure, in particular when magazines are stacked. The flexible pouch must not burst and the stopper member must not leak. In general, it is the stopper member that supports all of the pressure, since its thickness, although small, is greater than the thickness of the pouch.

The stopper member of document WO 2007/125241 is not specially designed to withstand the pressure exerted by a stack of magazines.

An object of the present invention is to improve the ability of that type of stopper member to withstand pressure, but without complicating its manufacture nor its assembly.

To achieve this object, the present invention makes provision for the base body to be contained entirely inside the assembly part. Advantageously, the lid is also contained entirely inside the assembly part, such that the maximum thickness of the stopper member is defined by the assembly part. In a practical embodiment, the assembly part includes a collar that surrounds the base body and the lid. Advantageously, the collar defines a maximum thickness of the stopper member. Advantageously, the stopper member presents a configuration that is generally flat in such a manner as to extend in a plane, the maximum thickness of the collar extending perpendicularly to the plane. The collar thus performs a support or beam function that takes up all of the pressure exerted on the dispenser. The base body and the lid are not stressed or flattened against the assembly part.

According to another characteristic of the invention, the base body is received by leaktight snap-fastening inside the collar of the assembly part. Given that the base body is not subjected to pressure and that the collar easily withstands the pressure, the leaktight snap-fastening of the body in the collar is not subjected to stresses that could rupture its sealing and create leaks.

In another aspect of the invention, the lid defines a maximum thickness of the stopper member. In this configuration, the collar and the lid each define a maximum thickness of the stopper member. The collar and the lid withstand the pressure individually, without there being any stress between them: the collar constitutes an annular support, while the lid constitutes a localized central support.

Advantageously, the assembly part defines a sealing zone for coming into leaktight contact with the opening of the reservoir.

The present invention also defines a fluid dispenser having a reservoir of variable volume that comprises at least one flexible sheet defining an opening in which the stopper member is mounted. The reservoir is preferably formed by a pouch constituted by one or two flexible sheets. In a variant, the reservoir can also be formed from a flexible sheet and from another element, such as a thermoformed shell, for example. In addition, it is not impossible for the stopper member to be mounted on the thermoformed shell, which would then include an opening for receiving the stopper member. Such a dispenser can present thickness that is very small, lying in the range about 3 millimeters (mm) to 5 mm, or less. The thickness of the dispenser is constituted essentially by the thickness of the stopper member, given that the flexible sheets present insignificant thickness. Consequently, it is possible to use such a flat dispenser as a fluid sample that can be inserted in magazine publications. The ability to withstand pressure is guaranteed by the collar, and optionally by the lid, which define the maximum thickness of the stopper member.

The present invention is described more fully below with reference to the accompanying drawings, which show an embodiment of the invention by way of non-limiting example.

Figure 1:
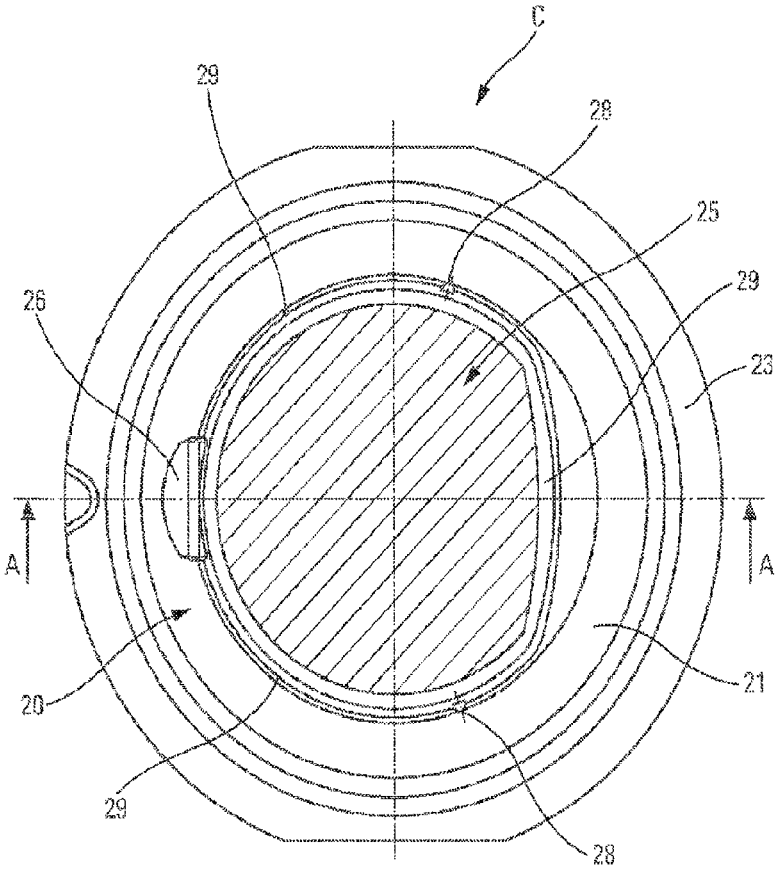
FIG. 1 is a plan view of a stopper member of the invention.
Figure 2:
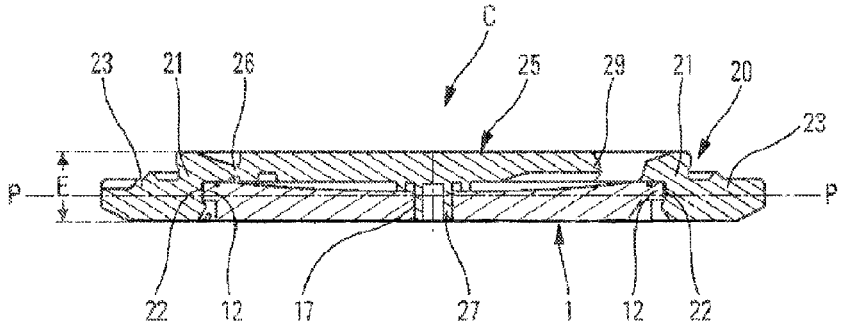
FIG. 2 is a vertical section view through the FIG. 1 stopper member in its closed state.
Figure 3:
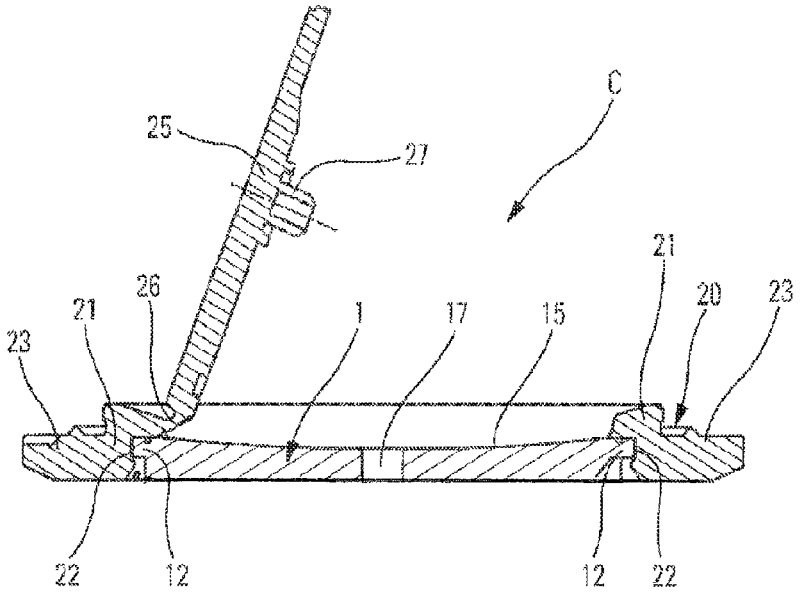
FIG. 3 is a view similar to the view in FIG. 2 showing the stopper member in its open state.

The structure and the functioning of a stopper member constituting a non-limiting embodiment of the invention are described in detail below. Integrating this stopper member in a dispenser of the present invention is described thereafter.

The stopper member shown in FIGS. 1 to 4 is designated overall by the letter C. It essentially comprises three component elements, namely a base body 1, an assembly part 20, and a lid 25. The assembly part 20 and the lid 25 can be made as a single piece so as to form only a single molding. The lid 25 can be connected to the assembly part 20 via a hinge 26 that can be in the form of a bridge of flexible material. The stopper member is relatively flat, such that it is possible to define a plane P in which it extends.

In this embodiment, the base body 1 is in the form of a washer or a disk defining a concave dish 15 that is pierced at its center by a dispenser orifice 17 that passes through the thickness of the body, so as to open out to the bottom surface.

The dish 15 serves as a fluid collection receptacle. On its outer periphery, the base body forms an annular flange 12 that projects radially outwards.

The base body 1 is preferably made by injection-molding a plastics material. In this embodiment, it presents a shape that is annular or circular: however, other geometrical shapes can be envisaged, such as polygonal or oblong shapes, for example. In this embodiment, the bottom surface of the base body is completely plane: however, it is possible to imagine that the surface is made with arbitrary, or specific, profiles that encourage fluid to flow towards the dispenser orifice 17.

In this non-limiting embodiment, the assembly part 20 is in the form of a ring that is preferably complete and closed. However, it is possible to imagine assembly parts that are partially annular or even polygonal in shape. Whatever the configuration, it is necessary for the assembly part to be adaptable on the base body. The assembly part 20 includes an annular collar 21 that presents a vertical or axial thickness E in the direction perpendicular to the plane P. The thickness E is the maximum thickness of the stopper member. On its inner periphery, the collar defines an annular snap-fastening groove 22 for receiving, in stationary and leaktight manner, the flange 12 of the base body 1. In a variant that is not shown, the base body and the assembly part may be over-molded or bi-injected. On its outer periphery, the collar extends to form a sealing zone 23 that is substantially or completely annular in shape. The sealing zone 23 serves as a fastener surface for fastening the flexible sheet constituting the flexible pouch of the dispenser of the invention, as described below.

The lid 25 is advantageously made integrally with the assembly part 20, and also presents a disk or washer shape that is disposed inside the assembly part 20, as can be seen in the figures. However, the lid may present a grip cutout 29 where the user may take hold of the lid. The lid 25 is connected to the inner periphery of the collar 21 via a flexible hinge 26, and also via one or more bridges 28 of material, as can be seen in FIG. 1. The top surface of the lid 25 may be situated in the same plane as the top of the collar 21. The outer peripheral edge of the lid 25 is thus separated from the collar by annular slot segments 29 that are separated by the bridges 28 of material and by the flexible hinge 26. At its center, the lid 25 defines a closure pin 27 that extends from the bottom surface of the lid. The lid is contained entirely in the volume defined by the assembly part. The pin could also be off-center, providing the dispenser orifice 17 is also off-center.

It should be observed that the maximum thickness of the lid, at the pin 27, is equal to the maximum thickness of the collar, namely E, that corresponds to the maximum thickness of the stopper member.

When the stopper member C has just been assembled, as shown in FIG. 1, the lid 25 is connected to the assembly part 20 not only via the flexible hinge 26, but also via the bridges 28 of material that are thus still intact. This is the configuration of the stopper member C before the lid is used or opened for the first time. In this initial configuration, the integrity of the bridges 28 of material gives the user or the purchaser an infallible visual indication that the stopper member has never been opened. In other words, the bridges 28 of material fulfill a function of guaranteeing to the user the absence of any previous use.

It should also be observed that the stopper member C of the present invention presents thickness that is very small, lying in the range about 3 mm to 5 mm. This is made possible by the fact that the base body 1 and the lid 25 are engaged completely inside the assembly part 20. The maximum thickness of the stopper member corresponds to the maximum thickness E of the collar 21, thereby ensuring it has very good ability to withstand pressure. The single-piece and solid design of the collar enables it to provide a support, prop, or spacer function that is practically non-deformable, even when subjected to considerable pressure. This great strength makes it possible to make dispensers that are suitable for being inserted in magazines.

Figure 4:
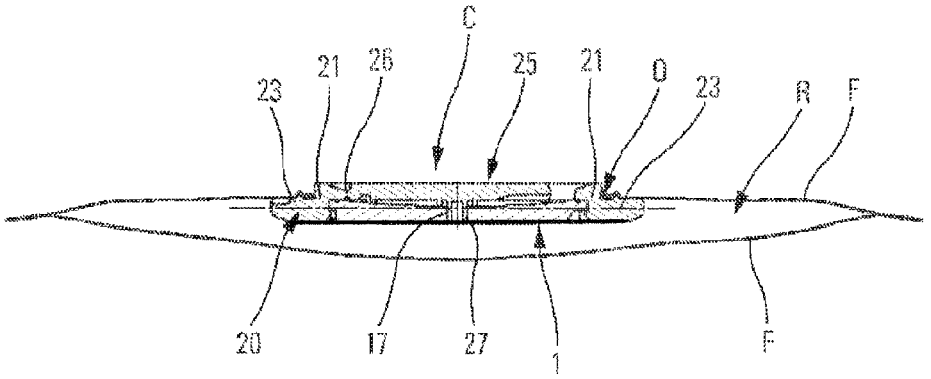
FIG. 4 is a vertical section view showing the stopper member in its closed state and connected to flexible sheets to form a flexible pouch.

FIG. 4 shows a dispenser including a reservoir R constituted by two flexible sheets F that are connected together on their peripheries in such a manner as to form a flexible pouch for containing fluid. One of the sheets F is perforated with a plane annular opening O that is heat-sealed (or fastened by some other means) on the sealing zone 23 of the stopper member C. Before the dispenser is used for the first time, the lid must be opened, and this causes the bridges 28 to rupture, and releases the dispenser orifice 17. By squeezing the flexible pouch, fluid is forced through the dispenser orifice and may be collected by the user from the dish 15. Then, the lid may be put back into place, in such a manner as to close the dispenser orifice.

By means of the characteristics of the invention, it is possible to manufacture easily and at low cost a fluid dispenser having a stopper member that is put into place before the pouch is formed. In addition, the stopper member can advantageously integrate first-use safety means, but without complicating its molding or its assembly. Finally, a dispenser is obtained that presents minimum thickness and maximum strength. As a result, it is possible to insert such a dispenser in magazines as an advertising sample.

The invention claimed is:

1. A stopper member for mounting on an opening of a fluid reservoir, said member comprising:

a base body forming a fluid dispenser orifice;

a separate assembly part, including a collar defining a solid thickness, in which the base body is received in stationary manner; and a closure lid for closing the dispenser orifice, the lid being connected to the assembly part via a hinge, the lid and the assembly part forming a single-piece molding, the lid and the assembly part being molded as a single piece, initially being connected together via at least one bridge of molded material, the first opening of the lid causing the bridge to rupture and releasing the dispenser orifice; and the base body is inscribed entirely inside the assembly part, wherein the base body and the assembly part are distinct parts that are separately formed, wherein the collar surrounds the base body and the lid, and wherein the collar defines a maximum thickness of the stopper member.

2. The stopper member according to claim 1, wherein the lid is inscribed entirely inside the assembly part.

3. The stopper member according to claim 1, presenting a configuration that is generally flat in such a manner as to extend in a plane, the maximum thickness of the collar extending perpendicularly to the plane.

4. The stopper member according to claim 1, wherein the base body is received by leaktight snap-fastening inside the collar of the assembly part.

5. The stopper member according to claim 1, wherein the lid defines a maximum thickness of the stopper member.

6. The stopper member according to claim 1, wherein the collar and the lid each define a maximum thickness of the stopper member.

7. The stopper member according to claim 1, wherein the assembly part defines a sealing zone for coming into leaktight contact with the opening of the reservoir.

8. A fluid dispenser comprising:

a fluid reservoir of variable volume that comprises at least one flexible sheet defining an opening; and a stopper member according to claim 1 mounted in the opening of the sheet.

9. The stopper member according to claim 1, wherein the assembly part forms a ring and an outermost periphery of the base body is inscribed within the ring of the assembly part.

10. A stopper member for mounting on an opening of a fluid reservoir, the member presenting a generally planar structure extending in a plane, the member comprising:

a base body comprising a fluid dispenser orifice;

an assembly part including a collar defining a solid thickness in which the base body is received; and a lid that closes the dispenser orifice, the lid connected to the assembly part via a hinge; and the base body is inscribed inside the assembly part with an outermost peripheral edge of the base body contained within the assembly part, such that forces applied to the member in a direction substantially parallel to the plane in which the member extends are borne by the assembly part, wherein the base body and the assembly part are separately formed, and wherein the collar defines a maximum thickness of the stopper member.

11. The stopper member according to claim 10, wherein the assembly part forms a ring and the outermost peripheral edge of the base body is inscribed within the ring of the assembly part.

12. The stopper member according to claim 10, wherein the lid and the assembly part-are a one-piece integral construction.

13. The stopper member according to claim 10, wherein, the lid and the assembly part are also connected by a frangible bridge that is configured to break upon opening of the lid about the hinge.

14. The stopper member according to claim 1, wherein the collar comprises an annular snap-fastening groove in which that base body is received.

* * * * *